US005430992A

United States Patent [19]

Olson

[11] Patent Number: 5,430,992

[45] Date of Patent: Jul. 11, 1995

[54] STACKED ARTICLE CARRIER PACKAGING

[75] Inventor: Allen L. Olson, Crosby, Minn.

[73] Assignee: Riverwood International Corporation, Denver, Colo.

[21] Appl. No.: 123,741

[22] Filed: Sep. 20, 1993

[51] Int. Cl.[6] ..... B65B 11/58; B65B 13/02; B65B 35/50; B65B 35/56

[52] U.S. Cl. ..... 53/399; 53/413; 53/419; 53/446; 53/447; 53/449

[58] Field of Search ..... 53/399, 411, 413, 419, 53/447, 449, 540, 176, 154, 544, 446

[56] References Cited

U.S. PATENT DOCUMENTS

| | | | |
|---|---|---|---|
| 2,277,408 | 3/1942 | Molins et al. | 53/540 X |
| 2,679,281 | 5/1954 | Paulucci | 53/176 X |
| 2,885,839 | 5/1959 | Weiss | 53/413 X |
| 2,901,873 | 9/1959 | Enos | 53/419 |
| 3,201,912 | 8/1965 | Wozniak . | |
| 3,850,282 | 11/1974 | Calvert et al. . | |
| 3,861,530 | 1/1975 | Calvert . | |
| 4,050,216 | 9/1977 | Stenberg | 53/413 |
| 4,475,653 | 10/1984 | Ullman | 53/48.2 X |
| 4,841,711 | 6/1989 | Lems et al. | 53/449 X |
| 4,947,624 | 8/1990 | Cones et al. | 53/540 |

*Primary Examiner*—Linda Johnson
*Attorney, Agent, or Firm*—Anthony G. Eggink

[57] ABSTRACT

A method to form stacked article groups utilizing packaged carton structures. The method utilizes first and second streams of packaged article groups, each packaged article group having predetermined graphic arrangements. The first and second streams are directed onto each other whereby the united packages form stacked article carriers having a unitary packaging graphic display.

13 Claims, 1 Drawing Sheet

STACKED ARTICLE CARRIER PACKAGING

BACKGROUND OF THE INVENTION

This invention relates to the packaging of article group carriers and the formation of stacked article carriers. Particularly, this invention relates to methods of stacking and uniting article group carriers utilizing carton structures having predetermined graphics.

The packaging of stacked articles, such as beverage and food containers and the like, has been found to be an economical and well accepted means to distribute products. These benefits extend to both the distributor and to the consumer. The primary limitation to the distribution of stacked articles, such as stacked beverage cans, has been the ability to form and package such stacked article groups in a fast and economical manner. The methods of this invention utilize carton structures to package stacked article units.

SUMMARY OF THE INVENTION

The present invention provides a method of forming and packaging stacked articles utilizing carton structures. The stacked article units are formed by providing first and second packaged article groups. The first and second packaged article groups, respectively, have predetermined graphic arrangements on their lateral portions. In one method, the second stream of packaged articles is directed onto the first stream of packaged articles so that their respective graphic arrangements are aligned to form a unitary graphic display. Thereafter, the first and second packages are united to form a stacked article carrier. These and other benefits will become clear from the following description by reference to the drawings.

DESCRIPTION OF THE PREFERRED EMBODIMENT

Figure 1:
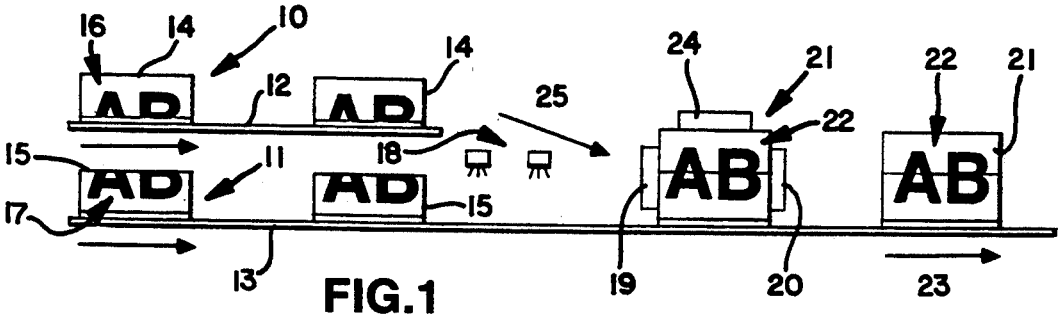
FIG. 1 is a flow diagram showing the method of this invention.

FIG. 1 is a flow diagram of the method of this invention wherein first and second packaged article groups are combined and united in a continuous process to form stacked article carriers. As shown, a first stream of packaged article groups 10, such as six packs of beverages packaged in cartons, are moved on conveyor 12. A second stream of packaged article groups 11 is shown traveling on conveyor 13 below that of stream 10. The packaged article stream 11 is similarly packaged as that of stream 10, however, as shown, the individual packages 14 of stream 10 is shown to have packaging graphics 16, whereas the individual packages 15 of stream 11.are shown to have packaging graphics 17.

As further shown, adhesive applicators 18 are positioned above conveyor 11 and above the packaged article groups 15 so that a quantity of adhesive may be placed on top of each packaged group 15 as it passes below the adhesive applicators 18. Thereafter, the individual packaged article groups 14 are positioned on the packaged article groups 17 of conveyor 11 via step 15. The flight bars 19 and 20 maintain the alignment of graphics 16 and 17 during the curing of the adhesive so that the united stacked packages 21 have the graphic pattern 22 properly aligned.

As the packaged article group stream 10 is combined with and stacked on the packaged article groups 15 of stream 11 via step 25, the respective packaging graphics 16 and 17 are aligned to form a united stacked article carrier 21 having graphics 22. The graphics 16 and 17, as shown, are laterally positioned on the top and bottom packages or cartons 14 and 15, respectively, whereby when combined the completed graphics 22 are culminated. To aid in aligning the individual packages 14 and 15, a plurality of flight bars 19 and 20 may be utilized. Such flight bars may be attached to conveyor 23, as known in the art.

Alternatively to the adhesive uniting step described, the intersection between individual packages 14 and 15 may be peripherally taped to unite the packages of streams 10 and 11 to form the stream of stacked packages 21 on conveyor 23. Other means of uniting the packages 14 and 15 may also be utilized to practice the methods of this invention, such as banding or strapping, as will be further described.

Preferably, the tops or upper surfaces of the individual packaged article groups 14 are provided with handle members for use by the consumer. However, the lower packaged article groups 15 may be similarly configured so that a consumer may separate the upper and lower packaged article groups and be provided with a pair of easily transportable sub-units. Alternatively, the strapping of banding members may also be configured to provide handle members on the completed packages 21.

In summary, the process of FIG. 1 permits a manufacturer or distributor to utilize existing packaging machinery and by the manipulation of the packaging graphics to, thereby, unite stacked packaged groups to produce taller stacked carrier units having twice the laterally disposed advertising display surfaces.

Figure 2:
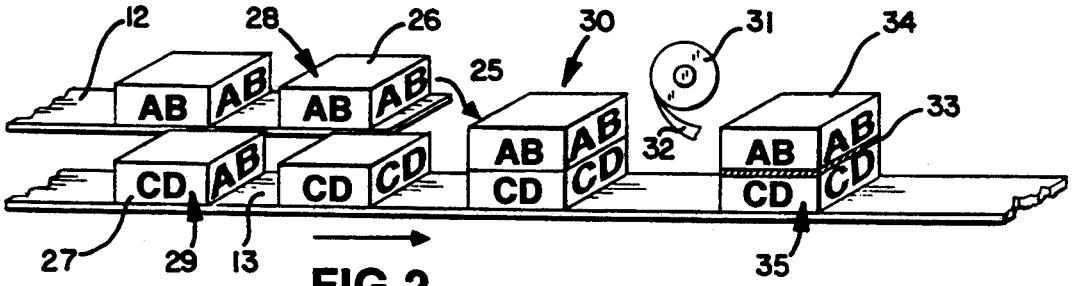
FIG. 2 is a flow diagram showing an alternate method of this invention.

FIG. 2 illustrates a method whereby the packaged article groups 26 and 27 have respective packaging graphics 28 and 29 which are separate and distinct from each other. Subsequent the stacking step 25 to form the stacked article carriers 30 a segment of tape 33 is utilized to unite the carrier unit 34 at the peripheral seam between the packaged article groups 26 and 27. The tape segment 33 is applied in a known manner by severing the segment from the extended tape portion 32 of tape supply 31. The resultant packaging graphics 35 may display a total advertising assembly whereby the respective top and bottom individual graphics 28 and 29 each form one half of the total. Further, the tape segment 33 may be colored similar to the background color of the packages 26 and 27 so that the united stacked article carrier unit 34 displays a unitary packaging graphic 35.

Figure 3:
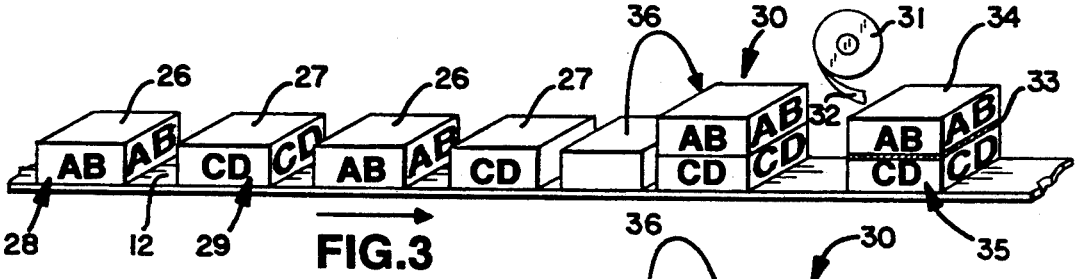
FIG. 3 is a flow diagram showing another method of this invention.
Figure 4:
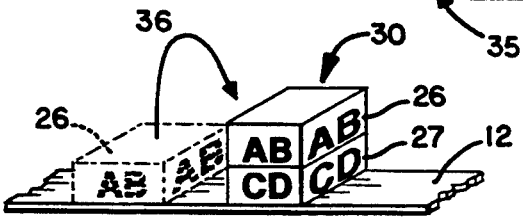
FIG. 4 shows a portion of the method of FIG. 3.

FIG. 3 illustrates a method whereby alternate packaged article groups have similar packaging graphics 28 and 29. This method permits a manufacturer or distributor to also utilize existing packaging machinery to unite and produce stacked article units. By utilizing two carton supply magazines or alternating two carton supply magazines or alternating the supply of individual cartons, a stream of alternate packaged article groups is obtained. As shown in FIG. 4, alternate packaged groups are stacked upon each other to provide a stream of stacked article carriers 30 which subsequently may be united by means of a taping step as discussed above with respect to FIG. 2.

Figure 5:
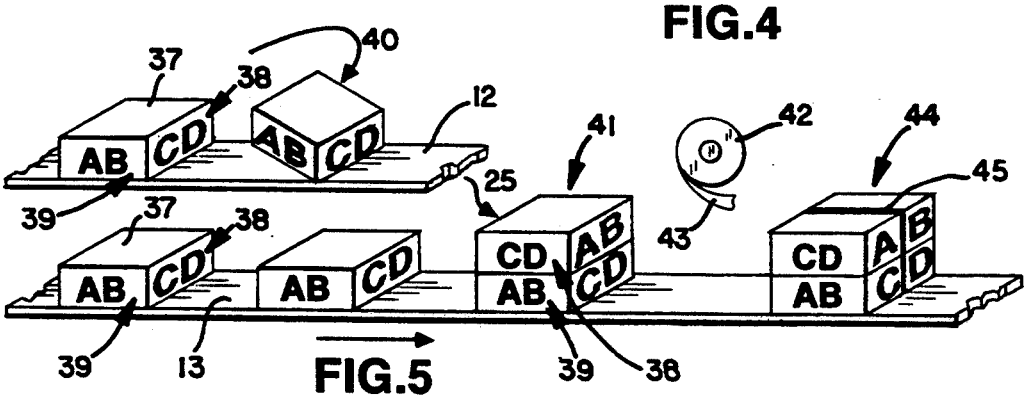
FIG. 5 shows another method of the present invention.

FIG. 5 illustrates another method of forming stacked article carriers whereby packaged article groups 37 are provided with different lateral packaging graphics 38 and 39 which may be moved on one or more conveyors, i.e., 12 and 13. As shown, the stream of packaged groups 37 on conveyor 12 is rotated via step 40 and then combined with or stacked onto the packaged groups 37 on conveyor 13 via step 25 to form stacked article carriers 41. The package rotating step 40 and positioning step 25 may be effectuated by equipment known in the packaging and material handling art. The top and bottom packaged article groups are subsequently united as discussed with respect to the methods of FIGS. 1–3, or, as shown, be united by banding or strapping. As shown, a peripheral band 45 is severed from the end portion 43 of a band or strap supply 42. The strapping member 45 may also be utilized by a consumer as a handle member for carrying the stacked unit 44.

As many changes are possible to the processes of this invention utilizing the teachings thereof, the descriptions above, and the accompanying drawings should be interpreted in the illustrative and not the limited sense.

That which is claimed is:

1. A method of forming stacked article carrier units comprising:

a) providing a stream of first packaged articles, each first package having a top portion and a predetermined graphic arrangement on its lateral portions;

b) providing and aligning a stream of second packaged articles with respect to said stream of first packaged articles, each second package having a bottom portion whereby the placement of a second package onto the top of a first package forms a peripheral intersection between the top portion of the first package and the bottom portion of the second package, each second package further having a predetermined graphic arrangement on its lateral portions, said predetermined graphic arrangements of said first and aligned second streams further being constructed and arranged to be in vertical alignment with each other at the peripheral intersection between each said first and second packaged articles;

c) vertically directing said aligned second packaged articles on top of the first packaged articles so that the predetermined graphic arrangements of each package is vertically aligned with the predetermined graphic arrangements of the first packaged articles;

d) applying an adhesive between each said first and second packaged articles and uniting said aligned first and second packages to form a stacked article carrier having a horizontally disposed peripheral intersection between said first and second packaged articles; and e) applying a tape segment about the peripheral intersection of each said first and second packaged articles to thereby cover said peripheral intersection.

2. The method of claim 1, wherein said tape segment application is positioned in a manner to coordinate with said predetermined first and second graphic arrangements.

3. The method of claim 1, wherein said uniting step d) is further comprised of applying at least one vertically disposed strap about each said stacked first and second packages.

4. The method of claim 1, wherein at least said second packaged articles are provided with handle members.

5. A method of forming stacked article carrier units comprising:

providing a stream of first packaged articles, each first package having a top and a predetermined graphic arrangement on its lateral portions;

b) providing a stream of second packaged articles, each second package having a bottom and a second predetermined graphic arrangement on its lateral portions, said predetermined graphic arrangements of said first and second streams being constructed and arranged to be in alignment with each other when vertically united whereby the top of the first package and the bottom of the second package form a peripheral intersection between the first and second packaged articles;

c) aligning said stream of second packaged articles with respect to said stream of first packaged articles;

d) directing said second packaged articles on top of the first packaged articles so that the predetermined graphic arrangements of each second package is aligned with the predetermined graphic arrangements of the first packaged articles;

e) applying an adhesive between each first and second package and uniting said aligned first and second packages; and f) applying a tape segment to cover the peripheral intersection between each said united first and second package in a manner to coordinate said predetermined first and second graphic arrangements to thereby provide stacked article carrier units.

6. The method of claim 5, wherein pressure is applied to the top of each first package subsequent the adhesive application step.

7. The method of claim 5, wherein said method is further comprised of applying at least one strap about each said stacked first and second packages.

8. The method of claim 5, wherein at least said second packaged articles are provided with handle members.

9. A method of forming stacked article carrier units comprising: providing a stream of first packaged articles, each first package having a top, a bottom and a plurality of side members and having different predetermined graphic arrangement on at least two of its side members;

b) providing a stream of second packaged articles, each second package having a top, a bottom and a plurality of side members and having different predetermined graphic arrangement on at least two of its side members, said top member of said first package and said bottom member of said second package forming a peripheral intersection between the first and second packages when said first and second packages are in a vertically stacked arrangement, said respective side members of said first and second package streams being constructed and arranged to form a complete and aligned graphic arrangement at the peripheral intersection of said first and second packaged articles when in a vertically stacked arrangement;

c) aligning said stream of second packaged articles with respect to said stream of first packaged articles;

d) applying an adhesive between each said top member of said first package and each said bottom member of said second packaged articles;

e) directing the bottom member of each said second packaged articles onto said top member of each said first packaged articles to form stacked packages;

f) maintaining the alignment of said stacked packages by moving the stacked packages by means of a conveyor having vertically disposed flight bars; and g) placing pressure on the top of each first package of said stacked package to unite said aligned first and second packages to form a stacked article carrier.

10. The method of claim 9, wherein said method is further comprised of applying a tape segment about the peripheral intersection between each first and second package.

11. The method of claim 10, wherein said tape segment application is positioned in a manner to coordinate with said predetermined first and second graphic arrangements.

12. The method of claim 9, wherein said method is further comprised of applying at least one strap about each said stacked first and second packages.

13. The method of claim 9, wherein at least said second packaged articles are provided with handle members.

* * * * *